US005088659A

United States Patent [19]

Neff et al.

[11] Patent Number: 5,088,659

[45] Date of Patent: Feb. 18, 1992

[54] PROJECTILE EQUIPPED WITH AN INFRARED SEARCH SYSTEM AT ITS BOW

[75] Inventors: Helmut Neff; Jürgen Heinrich, both of Hermannsburg; Gerhard Glotz, Celle, all of Fed. Rep. of Germany

[73] Assignee: TZN Forschungs-und Entwicklungszentrum Untlerluss GmbH, Unterluss, Fed. Rep. of Germany

[21] Appl. No.: 672,656

[22] Filed: Mar. 8, 1991

[30] Foreign Application Priority Data

Mar. 10, 1990 [DE] Fed. Rep. of Germany ..... 4007712

[51] Int. Cl.[5] ..... F41G 7/26

[52] U.S. Cl. ..... 244/3.16

[58] Field of Search ..... 244/3.16, 3.22

[56] References Cited

U.S. PATENT DOCUMENTS

| | | | |
|---|---|---|---|
| 3,863,262 | 1/1975 | Crofut et al. | 354/5 |
| 3,935,818 | 2/1976 | Johnson et al. | 244/3.16 |
| 3,954,228 | 5/1976 | Davis, Jr. | 244/3.16 |
| 4,024,392 | 5/1977 | Teppo et al. | 250/216 |
| 4,180,822 | 12/1979 | Hudson et al. | 346/108 |
| 4,329,579 | 5/1982 | Jansen et al. | 244/3.16 |
| 4,347,996 | 9/1982 | Grosso | 244/3.16 |
| 4,504,110 | 3/1985 | Pittenger | 350/6.3 |
| 4,516,853 | 5/1985 | Pearson | 356/152 |
| 4,533,094 | 8/1985 | Geis et al. | 244/3.22 |
| 4,560,120 | 12/1985 | Crawford et al. | 244/3.22 |
| 4,709,875 | 12/1987 | Cremosnik et al. | 244/3.13 |

FOREIGN PATENT DOCUMENTS

| | | |
|---|---|---|
| 0120775 | 10/1984 | European Pat. Off. . |
| 2923547 | 7/1980 | Fed. Rep. of Germany . |
| 3519786A1 | 12/1986 | Fed. Rep. of Germany . |
| 3623343 | 12/1989 | Fed. Rep. of Germany . |

OTHER PUBLICATIONS

Rogowski et al, "An Amplitude Modulated Laser System for Distance and Displacement Measurement", Proceedings of the International Society for Optical Engineering (SPIE), vol. 663, Laser Radar Technology and Applications, 1986, pp. 86-89.

*Primary Examiner*—Charles T. Jordan

*Attorney, Agent, or Firm*—Spencer & Frank

[57] ABSTRACT

A projectile equipped with an infrared target seeking system at its bow and an arrangement for correcting the flight course of the projectile, with the target seeking system having at least one deflection device for scanning the target area. To obtain a rosette-shaped scanning pattern of the target area without the use of gyro stabilized mechanical systems, the projectile rotates about its longitudinal axis and the target seeking system includes a laser which is followed by a beam deflecting device which deflects the laser beam periodically and linearly within a fixed scanning plane passing through the longitudinal axis of the projectile. Preferably the laser beam is also amplitude modulated.

7 Claims, 5 Drawing Sheets

PROJECTILE EQUIPPED WITH AN INFRARED SEARCH SYSTEM AT ITS BOW

BACKGROUND OF THE INVENTION

The present invention relates to a projectile provided with an infrared target seeking system at its bow and means for correcting the flight of the projectile, with the target seeking system having a deflection device for scanning the target area.

Successful combat against tactical and ballistic missiles with guns requires the use of sensor supported ammunition having a comparatively high target detection range and hit accuracy. The target detection sensor systems may here be active or passive systems. Active systems offer an opportunity for the autonomous determination of the target distance and thus permit modified proportional navigation with the result of improved hit accuracy. The various guided missile systems realized in the past require gyro stabilized systems of great mechanical complexity. These systems are often unable to withstand the stresses occurring upon launching.

For example, Federal Republic of Germany DE-AS 2,923,547, corresponding to U.S. Pat. No. 4,329,579, issued May 11th, 1982, discloses a target seeking device for missiles where the device includes a passive sensor. This device is essentially based on a gyro rotor mounted in a housing, with a detector being fixed to the housing at the central pivot arm. An optical system is disposed on the gyro rotor in order to image the field of view of the target seeking device which lies at infinity as a field of view image in the plane of the detector. The means for producing relative movement between the field of view image and the detector is a torque generator which acts on the gyro rotor and receives the appropriate scanning signals from a scanning signal generator. With suitable selection of the scanning signals, it is possible to produce a rosette-shaped scanning pattern of the target area. This has the particular advantage that a target detected in the vicinity of the center is covered more or less by every loop of the rosette. Thus the deviation of the target with reference to the center point can be determined at relatively little cost and the target seeking device can be adjusted correspondingly.

The above-described passive target seeking device with a rosette-like scanning pattern is further improved in Federal Republic of Germany Patent No. 3,623,343. In this case as well, a gyro stabilized system of great mechanical complexity is required.

U.S. Pat. No. 3,935,818 discloses a missile which is equipped with an optical target seeking device as well as with an optical proximity fuze. The receiver of the passive target seeking device simultaneously serves as the receiver for the active proximity fuze. This reference does not disclose an active target seeking method.

SUMMARY OF THE INVENTION

It is an object of the present invention to improve a projectile of the above-mentioned type which is provided with an infrared target seeking system so that, on the one hand, mechanical components are no longer required and, on the other hand, it is possible to scan the target area in a rosette pattern.

The above object is generally achieved according to the present invention by a projectile having an infrared target seeking system at its bow, and means, responsive to signals from said target seeking system, for correcting the flight course of the projectile, with the target seeking system including means for scanning a target area; and wherein: the projectile rotates about its longitudinal axis; the target seeking system includes a laser; and, the means for scanning includes means for deflecting an output beam of the laser, periodically and linearly within a fixed scanning plane passing through the longitudinal axis of the projectile, so that the rotation of the projectile causes the target area to be scanned in a rosette-shaped pattern. Preferably, the means for deflecting includes an acousto-optical deflection device disposed in the output beam path of the laser, and the target seeking system further includes an electro-optical modulator for amplitude modulation of the laser beam to provide a distance measurement.

The present invention is thus based on an active laser supported sensor system for target detection and guidance. The target area is scanned by means of the acousto-optical sensor system attached in the search head of the rotating projectile. The position of the projectile relative to the target and the line of sight angle can then be determined from the scanning parameters of the acousto-optical device and by receiving and evaluating the light reflected by the target. At least two control nozzles are employed to guide the flight direction of the projectile with these nozzles being disposed in a fixed, predetermined plane relative to the scanning plane of the laser.

Further details and advantages of the invention will now be described below in greater detail with reference to an embodiment thereof and the drawing figures.

DETAILED DESCRIPTION OF THE PREFERRED EMBODIMENT

Figure 1:
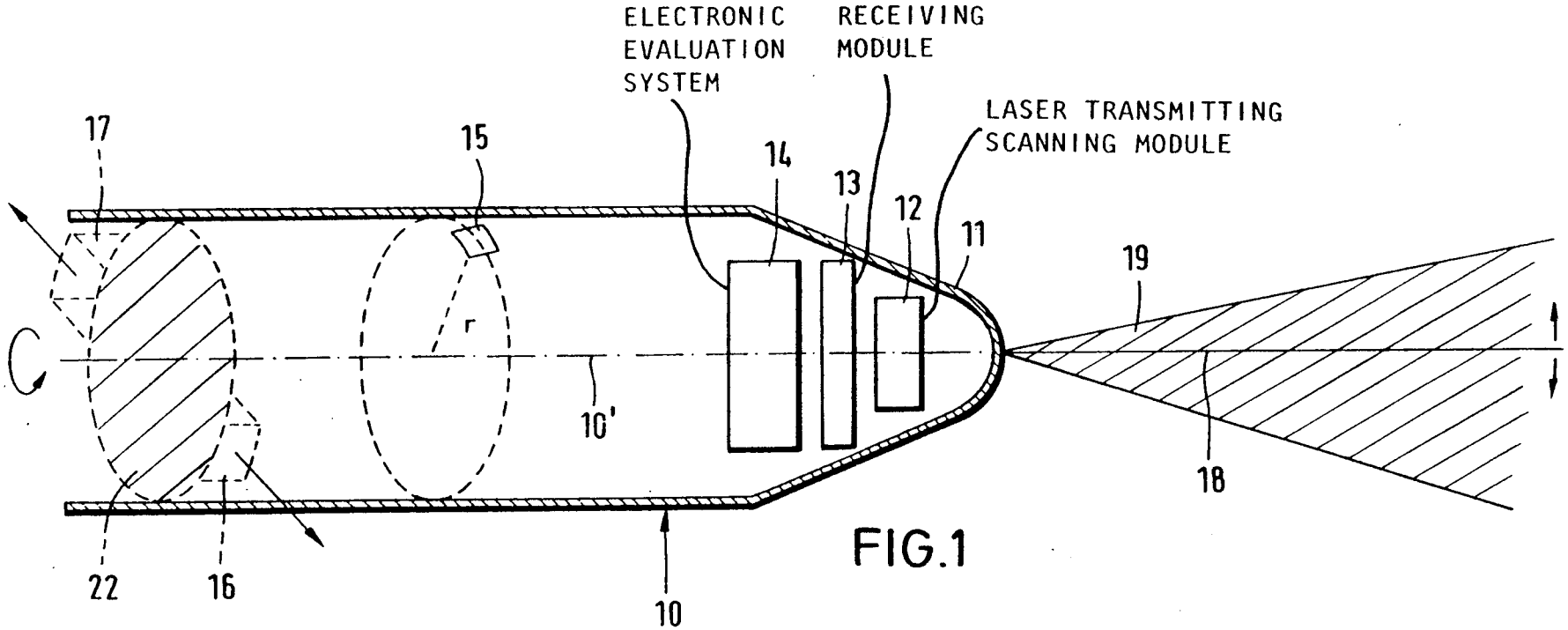
FIG. 1 is a schematic illustration of a projectile with a search system according to the invention.

In FIG. 1, the reference numeral 10 identifies a spin stabilized projectile which rotates about its longitudinal axis 10'. Projectile 10 has a dome 11, which is transparent for infrared radiation at its front end.

In the interior of projectile 10, there are disposed a laser transmitting and scanning module 12, a receiving module 13 and an electronic evaluation system 14 as well as a roll rate sensor 15 and a pair of radial thrust nozzles 16 and 17. The laser beam emanating from laser transmitting and scanning module 12 is marked 18 and the corresponding scanning plane is marked 19.

Figure 2:
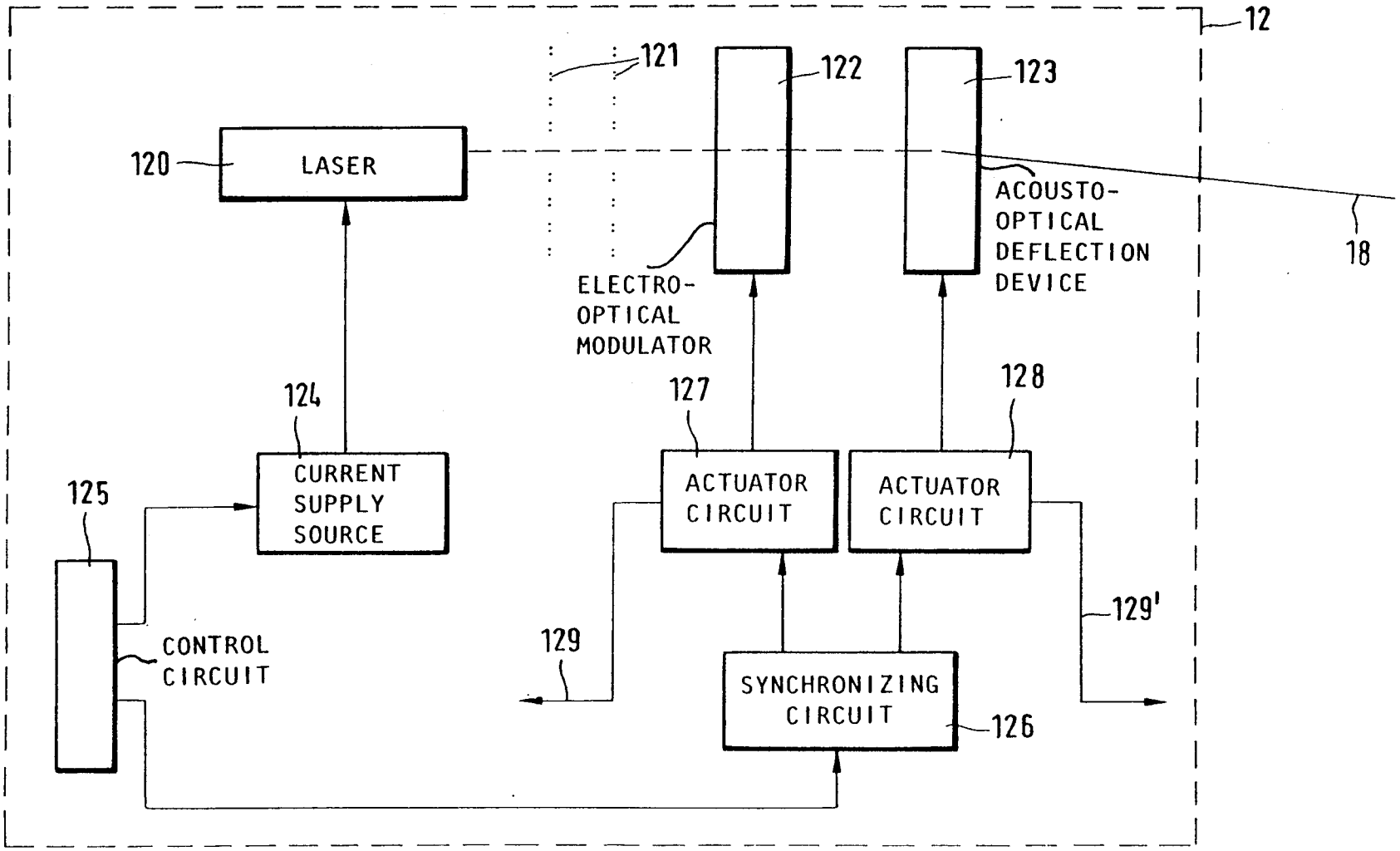
FIG. 2 is a block diagram of the structure of a laser transmitting and scanning module according to the invention.

The configuration of laser transmitting and scanning module 12 is shown in FIG. 2. It is essentially composed of a laser 120, e.g., a DC solid state laser, a lens arrangement 121 (indicated only schematically) connected in the path of the laser light for conditioning its beam 18, as well as a preferably electro-optical modulator 122 to amplitude modulate the laser beam 18. The amplitude modulation is necessary because the thus reduced bandwidth of the signal permits an increase in the signal to noise ratio. Moreover, amplitude modulation of the laser beam 18 is necessary to determine the distance of the projectile 10 from the target or as is explained. The deflection of the laser beam 18 is effected by means of an acousto-optical deflection device 23.

Electro-optical beam modulation systems at high bandwidth, consisting of the solid-state optical modulator and the associated electronic power supply, are already commercially avaliable. Examples are the modles 3500 and 3101 from Quantum Technology Inc., Lake Mary, Fla., U.S.A.

The solid state laser 120 is supplied with current from a current supply source 124 which is actuated by a control circuit 125. Also connected with control circuit 125, by way of a synchronization circuit 126, are actuating circuits 127 and 128 for the electro-optical modulator 122 and the acousto-optical deflection device 123, respectively. Actuation circuits 127 and 128, in turn, are connected via lines 129 and 129', respectively, with the electronic evaluation system 14 which will be described below.

Receiving module 13 is essentially composed of a fast photodiode 130. This photodiode 130 is preceded by an optical focusing system 131 (shown schematically) with which the incident laser light 132 reflected back from the target is focused on the photodiode 130. The output signals of photodiode 130 are amplified and filtered, if necessary, in a signal pre-processing device 133 and are then fed via a line 134 to electronic evaluation system 14.

Figure 4:
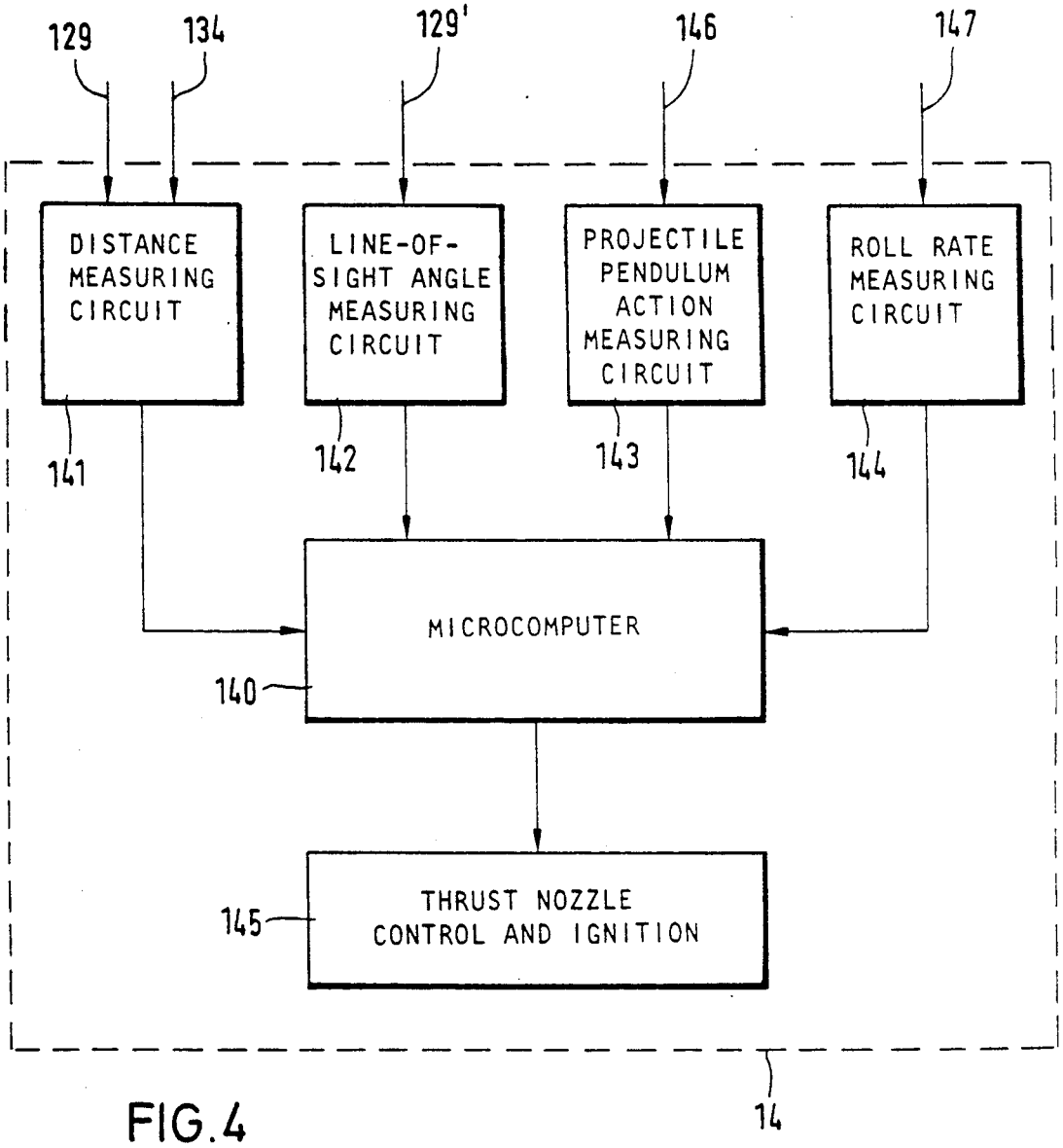
FIG. 4 is a block diagram of the electronic evaluation system for the received signals according to the invention.
Figure 3:
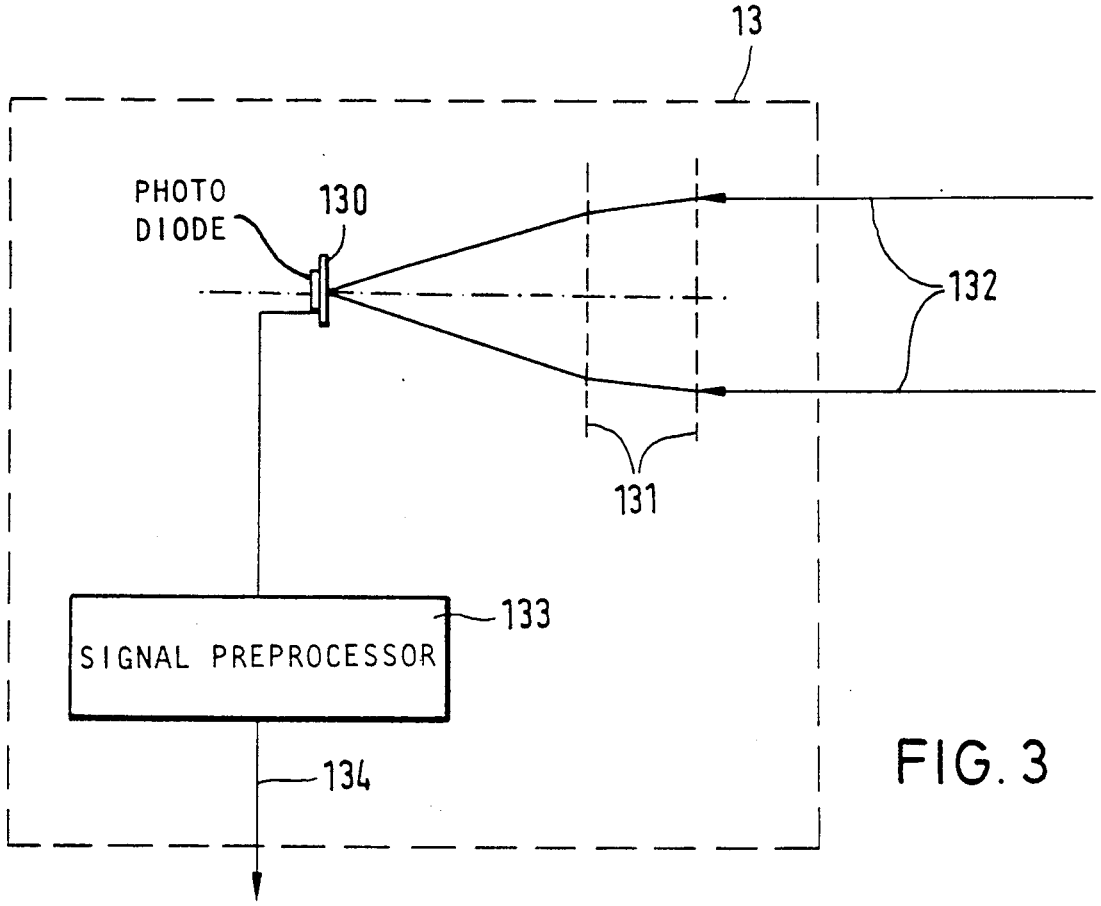
FIG. 3 is a block diagram of the arrangement of a receiving module for the laser light reflected by the target.

A block circuit diagram for the electronic evaluation system is shown in FIG. 4. The electronic evaluation system 14 is essentially composed of a microcomputer (μC) 140. The microcomputer has inputs connected with a circuit 141 for measuring the distance to the target, a circuit 142 for measuring the line-of-sight angle, a circuit 143 for measuring the pendulum action of the projectile 10, and a circuit 144 for measuring the roll rate. A correction in the path of the projectile is determined from the determined distance of the target, the line-of-sight angle and the line-of-sight rotational velocity derived therefrom as well as the roll rate and possibly the projectile pendulum action (pitch and yaw motion). The corresponding correction signals are then fed to radial thrust nozzles 16 and 17 so that the projectile is able to correspondingly change its trajectory. Moreover, the distance data can be utilized to activate the ignition.

The distance measurements in circuit 141 are preferably effected by the method disclosed in the publication by R. S. Rogowsky et al, entitled "An Amplitude Modulate Laser System for Distance and Displacement Measurement", PROCEEDINGS OF THE INTERNATIONAL SOCIETY FOR OPTICAL ENGINEERING (SPIE), Volume 663, Laser Radar Technology and Applications, 1986, pages 86–89. For this purpose, a method is employed which is used analogously for distance determinations in FMCW-RADAR (frequency modulated continuous wave radar). The emitted laser radiation, however, is modulated in modulator 122, such that the amplitude of the modulation frequency increases linearly within a predetermined period. The output signal or line 129 and the signal on line 134 corresponding to laser light reflected by the target are superposed with the aid of a mixer in circuit 141. At the output of the mixer, the difference in travel time between the two signals produces a low frequency, the so-called beat frequency, which is proportional to the distance.

Now several comments regarding the determination of the momentary line-of-sight angle and the line-of-sight rotational velocity derived therefrom. The line-of-sight angle, is the angle between the line of sight and the longitudinal rotation axis 10' of the projectile. The line-of-sight angle is derived in the circuit 142 from the electrical operating parameters of the acousto-optical deflection unit or device 123 in that the operating voltage required to deflect the laser beam 18 is proportional (linear or square) to the deflection angle. The line-of-sight rotational velocity results from the change over time of the line-of-sight angle and is obtained by differentiation, for example by evaluation of two successive projectile revolutions.

Figure 5:
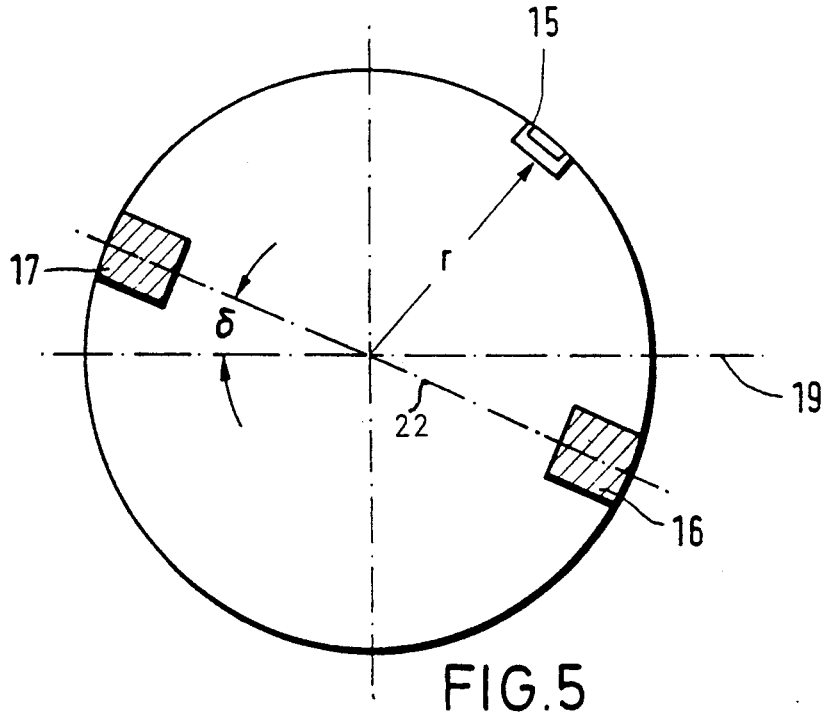
FIG. 5 is a schematic front view of the projectile showing the arrangement of the thrust nozzles according to the invention.

In order to determine the roll rate, an acceleration pickup 15, for example, may be employed and its output fed via line 147 to circuit 14 which determines the rate of rotation ω of the projectile from the radial acceleration according to $$\omega = \sqrt{b_r/r}$$

where $b_r$ is the radial acceleration and r the radial distance of the acceleration pickup 15 from the rotation axis 10' of the projectile (see also FIG. 5).

Under certain circumstances it may be necessary to make a correction of the line-of-sight angle on the basis of projectile pendulum action (pitch and yaw motion). This can be effected either by the use of gyros or by acceleration pickups whose outputs are fed to circuit 143 via line 146. The line-of-sight angle here results from the generally known equations for so-called body fixed guidance.

The path correction calculation will now be explained for the example of a simplified proportionality navigation. For the case of a planar flying movement, the following relationship results for the transverse acceleration b with which an incoming missile is guided into the target:

$$b = k\ v\ (d8/dt + q)$$

where k is a proportionality constant;

v is the flying velocity;

$d\theta/dt$ is the line-of-sight rotational velocity; and q is the pitch angle velocity.

The v parameter is obtained form the change over time of the distance between the projectile and target; the line-or-sight rotational velocity is determinjed form the change over time of the line-of-sight angle. The pitch angle velocity can be corrected either with the aid of the gyro signals or the appropriately arranged configuration—not described in detail here—of acceleration pickups. For the generally occurring movement of the projectile in space, rolling and yawing movements must additionally be considered.

The corresponding correction signals are fed to oppositely disposed thrustover, nozzles or drives 16 and 17 which are shown schematically in FIG. 5. FIG. 5 also shows the position of the scanning plane 19 relative to the thrust nozzles or drives 16, 17 and the position of the roll rate sensor 15. Thrust nozzles 16 and 17 are preferably disposed along a line or plane 22 passing through the center of gravity of the projectile 10. Preferably, known hot gas or pulsed drives are employed. Scanning plane 19 and the line or plane 22 of the thrust nozzles 16 and 17 are turned relative to one another by an angle $\delta$. This results in a lead time $\tau$ during which the path correction by means of the input parameters can be effected. A determination of the time T for actuation of the thrust nozzles 16 is made with a fixed angle $\delta$, as described in greater detail above, from the rate of rotation $\omega$ of the projectile 10 obtained by means of roll rate sensor 15 which is attached at a distance r from the rotation axis 10' of the projectile 10.

Figure 6:
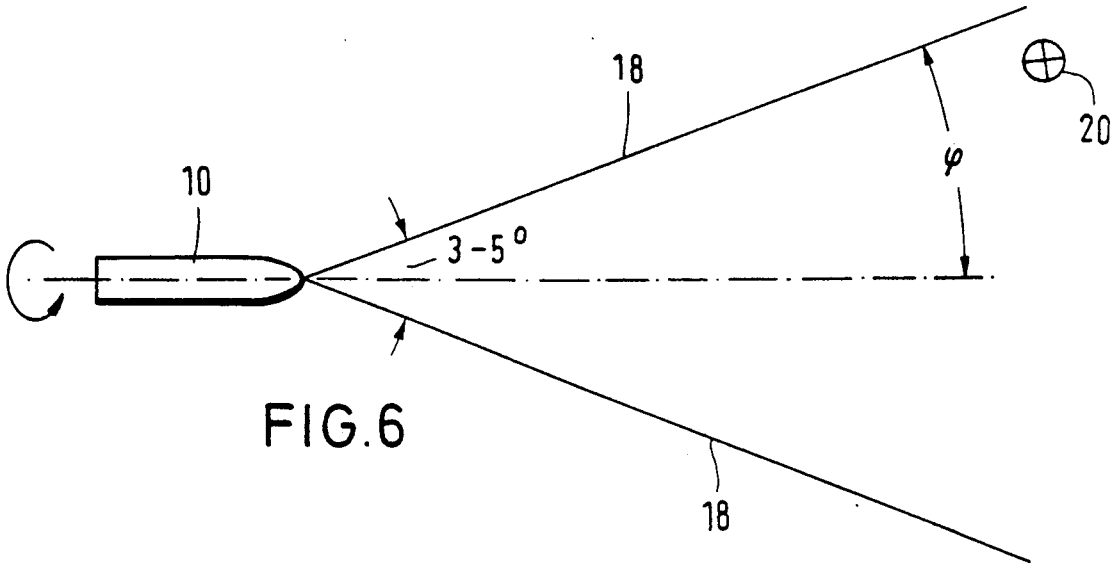
FIGS. 6 and 7 are schematic representations of the scanning process according to the system of the invention.
Figure 7:
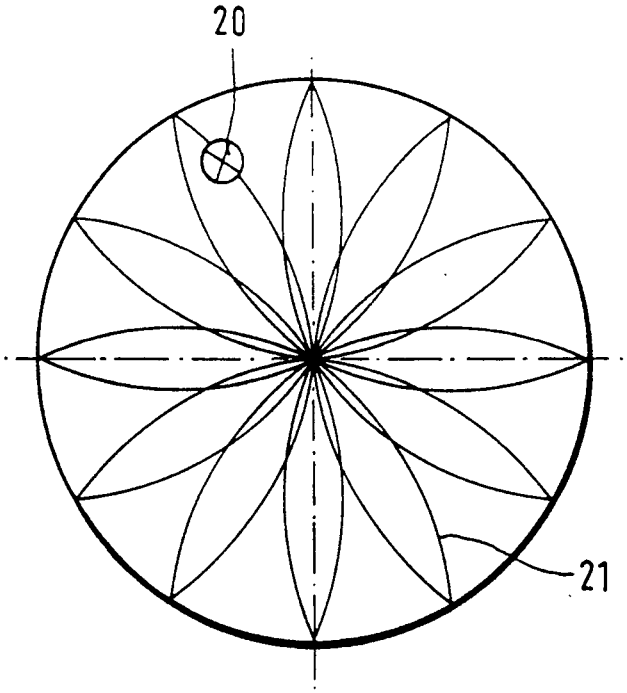

The scanning process is shown in FIGS. 6 and 7. The reference numeral 10 again identifies the rotating projectile, the laser beam is marked 18 and a target is marked 20. If the laser beam is periodically and linearly deflected over, e.g., an angle of 3°–5°, the rotation of the projectile at the angular velocity $\omega$ within a range from 50 to 200 Hz generates a rosette-shaped scanning pattern in the target region, as can be seen in FIG. 7, from which the line-of-sight angle $\phi$ can be determined on the basis of the scanning parameters of acousto-optical module 123 (FIG. 2) as well as the distance, as described above.

Acousto-optical beam deflection systems are already commercially available on request from a broad variety of suppliers. Examples are the model ADM-40 and AOD A50 B from Intra-Action-Corp. Bellwood, Ill., U.S.A.

The invention now being fully described, it will be apparent to one of ordinary skill in the art that any changes and modifications can be made thereto without departing from the spirit or scope of the invention as set forth herein.

What is claimed is:

1. In a projectile having an infrared target seeking system at its bow, and means, responsive to signals from said target seeking system, for correcting the flight course of the projectile, with said target seeking system including means for scanning a target area; the improvement wherein: the projectile rotates about its longitudinal axis; said target seeking system includes a laser; and said means for scanning includes means for deflecting an output beam of said laser, periodically and linearly within a fixed scanning plane passing through said longitudinal axis of said projectile, so that the rotation of said projectile causes the target area to be scanned in a rosette-shaped pattern.

2. A projectile as defined in claim 1 wherein said means for deflecting includes an acousto-optical deflection device disposed in the output beam path of said laser.

3. A projectile as defined in claim 2 wherein said target seeking system further includes an electro-optical modulator of amplitude modulation of the laser beam.

4. A projectile as defined in claim 3 wherein said means for correcting the flight course includes two oppositely disposed radially directed thrust nozzles located in a fixed, predetermined plane relative to the said scanning plane of the laser beam.

5. A projectile as defined in claim 4 wherein said plane of said thrust nozzles extends through said longitudinal axis and encloses an angle with said fixed scanning plane

6. A projectile as defined in claim 2 wherein said means for correcting the flight course includes two oppositely disposed radially directed thrust nozzles located in a fixed, predetermined plane relative to the said scanning plane of the laser beam.

7. A projectile as defined in claim 1 wherein said means for correcting the flight course includes two oppositely disposed radially directed thrust nozzles located in a fixed, predetermined plane relative to the said scanning plane of the laser beam.

* * * * *